US011452654B2

(12) United States Patent
McKeeman

(10) Patent No.: US 11,452,654 B2
(45) Date of Patent: Sep. 27, 2022

(54) PORTABLE HYPERBARIC CHAMBER DEVICE WITH FORWARD-FACING DOOR

(71) Applicant: Bruce Elgin McKeeman, Mound, MN (US)

(72) Inventor: Bruce Elgin McKeeman, Mound, MN (US)

( * ) Notice: Subject to any disclaimer, the term of this patent is extended or adjusted under 35 U.S.C. 154(b) by 421 days.

(21) Appl. No.: 16/855,799

(22) Filed: Apr. 22, 2020

(65) Prior Publication Data

US 2020/0330307 A1 Oct. 22, 2020

Related U.S. Application Data

(60) Provisional application No. 62/836,935, filed on Apr. 22, 2019.

(51) Int. Cl.
*A61G 10/02* (2006.01)
*A61G 10/00* (2006.01)

(52) U.S. Cl.
CPC ..... *A61G 10/026* (2013.01); *A61G 10/005* (2013.01); *A61G 2200/32* (2013.01)

(58) Field of Classification Search
CPC ..... A61G 10/00–04
See application file for complete search history.

(56) References Cited

U.S. PATENT DOCUMENTS 5,255,673 A * 10/1993 Cardwell ..... A61G 10/026 405/185
5,467,764 A * 11/1995 Gamow ..... B63C 11/325 128/200.24
2005/0109381 A1* 5/2005 Mosteller ..... A61G 10/026 135/97
2008/0210239 A1* 9/2008 Lewis ..... A61G 10/026 128/205.26
2014/0366881 A1* 12/2014 McKeeman ..... A61G 10/026 128/205.24

* cited by examiner

*Primary Examiner* — Thaddeus B Cox

(57) ABSTRACT

A portable hyperbaric chamber device with forward-facing door includes a frame, an inflatable chamber, a dump valve, at least one primary pressure relief valve, at least one secondary pressure relief valve, a plurality of fill valves. Access to the inflatable chamber is gain through a door panel of the inflatable chamber. The inflatable chamber is positioned within and secured to the frame. The plurality of fill valves is in fluid communication with the inflatable chamber so that the inflatable chamber can be pressured for usage. The dump valve is in fluid communication with the inflatable chamber to deflate the inflatable chamber. The primary pressure relief valve and the secondary pressure relief valve are in fluid communication with the inflatable chamber to maintain a safe internal pressure within the inflatable chamber to protect wellbeing of the users and the structural integrity of the complete apparatus.

19 Claims, 11 Drawing Sheets

CLOSED
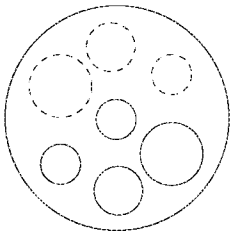
FIG. 11-A
LOW
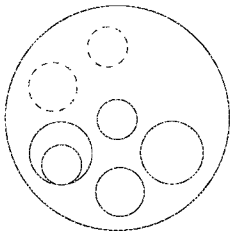
FIG. 11-B
MEDIUM
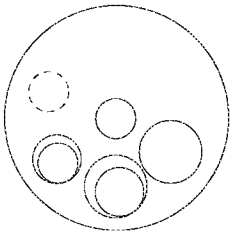
FIG. 11-C
HIGH
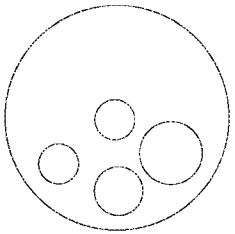
FIG. 11-D
MEDIUM
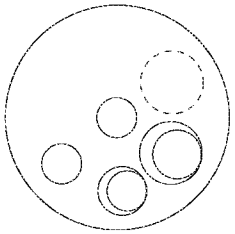
FIG. 11-E
LOW
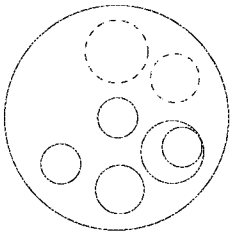
FIG. 11-F

PORTABLE HYPERBARIC CHAMBER DEVICE WITH FORWARD-FACING DOOR

The current application claims a priority to the U.S. Provisional Patent application Ser. No. 62/836,935 filed on Apr. 22, 2019.

FIELD OF THE INVENTION

The present invention relates generally to hyperbaric chamber devices. More specifically, the present invention is a portable hyperbaric chamber with a forward-facing door that provide a larger opening. The larger opening provide flexibility to roll in a stretcher, a wheelchair, and additional equipment to provide a comfortable stay for an individual or individuals that utilize the present invention.

BACKGROUND OF THE INVENTION

In present society, there has been an increase in the personalized usage of hyperbaric chamber devices. Currently, more users are investing in hyperbaric chamber devices. Most hyperbaric chamber devices utilize a longitudinal zipper fastener along a side wall of the hyperbaric chamber device so that the users can enter or exit the hyperbaric chamber device. However, with these hyperbaric chamber devices, it can be difficult for some users to enter or exit the hyperbaric chamber device. Such users can include users with limited mobility, users confined to a wheelchair or stretcher, users requiring a gurney, or users that require assistance in entering a hyperbaric chamber device. Additionally, due to the longitudinal nature of the entry-way of these hyperbaric chamber devices, it can be even more difficult for a caregiver to transport a user from a stretcher into the hyperbaric chamber devices.

It is an objective of the present invention is to provide users a portable hyperbaric chamber device with a forward-facing door. The present invention intends to provide users with a device that can make it easier for any user or users to enter a portable hyperbaric chamber device, wherein such users can include users with limited mobility, users confined to a wheelchair or stretcher, users requiring a gurney, or users that require assistance in entering a hyperbaric chamber device. The present invention intends to provide users with a portable hyperbaric chamber device with an attachment to allow for an easier transportation of an individual from a stretcher to inside of the chamber device. The present invention intends to provide users with a hyperbaric chamber device with a door that utilizes a more efficient air-sealing fastening of the entryway through two doubled-sided zipper fasteners.

SUMMARY OF THE INVENTION

The present invention is a portable hyperbaric chamber device with a forward-facing door. The present invention contains primarily a hyperbaric chamber unit and a frame. The hyperbaric chamber unit is an inflatable vessel that is integrated with transparent windows, pressure gages, a dump valve, a plurality of auxiliary ports, a plurality of fill valves, and a plurality of pressure release valves. A door panel of the inflatable vessel functions as the entry point to the portable hyperbaric chamber device. The inflatable vessel is constrained within and supported by the frame.

BRIEF DESCRIPTION OF THE DRAWINGS

FIG. 11-A is a basic inside view of the dump valve which shows the plurality of stationary holes and the plurality of rotary holes are completely sealed from one another, wherein the dump valve is completely sealed.

FIG. 11-B is a basic inside view of the dump valve which shows the plurality of stationary holes and the plurality of rotary holes are partially sealed from one another, wherein the dump valve allows a small amount of air to escape.

FIG. 11-C is a basic inside view of the dump valve which shows the plurality of stationary holes and the plurality of rotary holes are partially sealed from one another, wherein the dump valve allows a large amount of air to escape.

FIG. 11-D is a basic inside view of the dump valve which shows the plurality of stationary holes and the plurality of rotary holes are completely aligned with one another, wherein the dump is working at its full capacity.

FIG. 11-E is a basic inside view of the dump valve which shows the plurality of stationary holes and the plurality of rotary holes are partially sealed from one another, wherein the dump valve allows a large amount of air to escape.

FIG. 11-F is a basic inside view of the dump valve which shows the plurality of stationary holes and the plurality of rotary holes are partially sealed from one another, wherein the dump valve allows a small amount of air to escape.

DETAIL DESCRIPTIONS OF THE INVENTION

Figure 1:
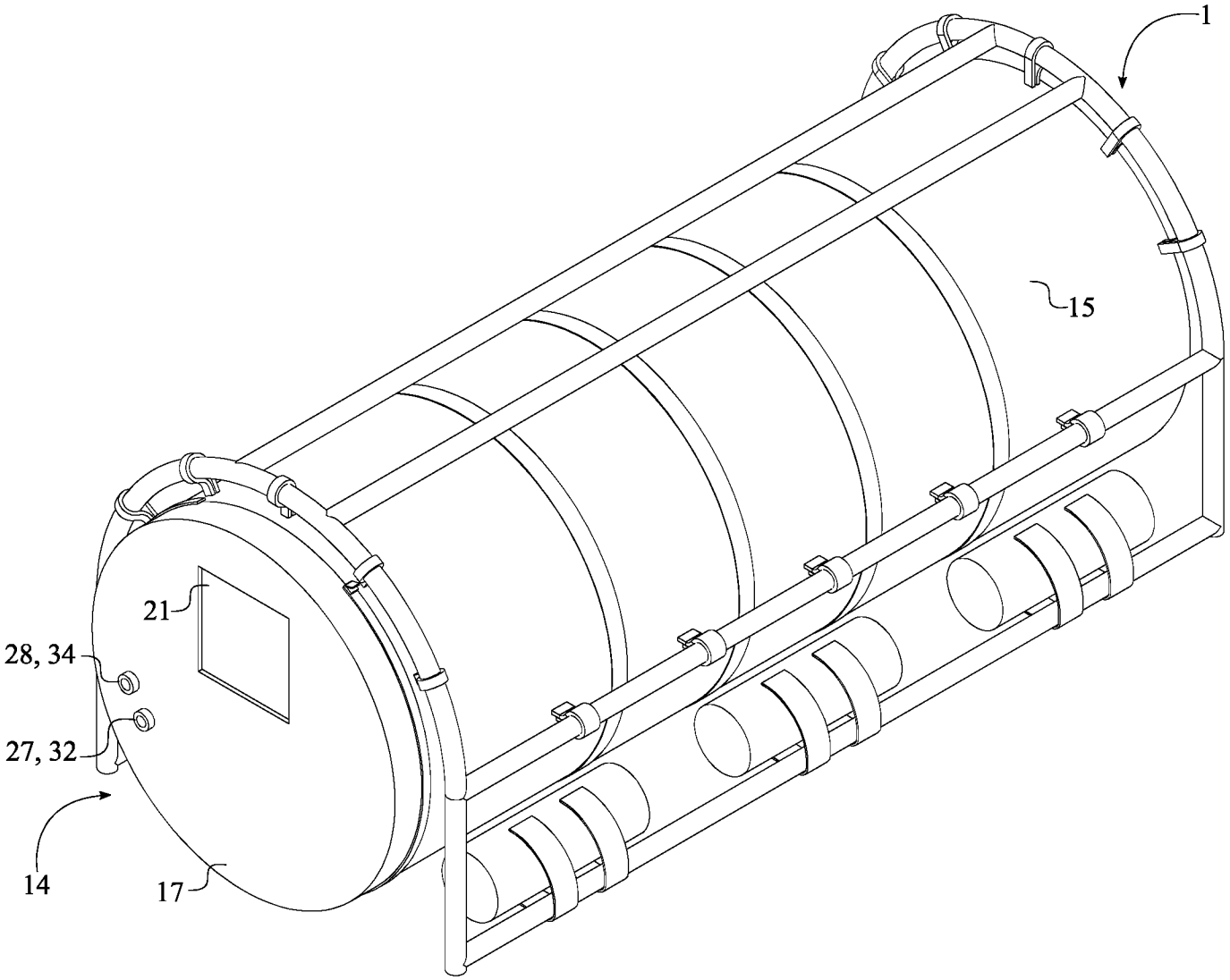
FIG. 1 is a front perspective view of the present invention.

All illustrations of the drawings are for the purpose of describing selected versions of the present invention and are not intended to limit the scope of the present invention.

The present invention is a portable hyperbaric chamber device with a forward-facing door. The present invention can be of any shape, size, material, features, type or kind, orientation, location, quantity, components, and arrangements of components that would allow the present invention to fulfill the objectives and intents of the present invention. However, it can be preferred that the present invention be of a general shape and size such that chamber of the vessel of the present invention can contain or support one or more fully-grown adult users. As shown in FIG. 1-4, the present invention comprises a frame 1, an inflatable chamber 14, a dump valve 25, at least one primary pressure relief valve 27, at least one secondary pressure relief valve 28, and a plurality of fill valves 29.

In reference to the general configuration of the present invention, the inflatable chamber 14 that functions as a pressured vessel to accommodate a user comprises a lateral panel 15, a rear panel 16, and a door panel 17 as shown in FIG. 1-4. The rear panel 16 and the door panel 17 are oppositely positioned of each other about the lateral panel 15 thus delineating an elongated cylindrical chamber. The rear panel 16 is perimetrically connected to the lateral panel 15. The door panel 17 is mounted to the lateral panel 15 so that the door panel 17 can be opened or closed from the inside or the outside of the inflatable chamber 14. The connection between the rear panel 16, the lateral panel 15, and the door panel 17 are preferably complete with the radio frequency (RF) welding so that the present invention can maintain high strength connection points for additional durability. The inflatable chamber 14 is positioned within the frame 1 as the lateral panel 15 is externally attached to the frame 1. The plurality of fill valves 29 is in fluid communication with the inflatable chamber 14 so that the inflatable chamber 14 can be pressurized with an operation of at least one compressor. The dump valve 25, which can deflate the inflatable chamber 14, is in fluid communication with the inflatable chamber 14. The primary pressure relief valve 27 is in fluid communication with the inflatable chamber 14 in order to maintain a safe pressurized environment for the user of the present invention. The secondary pressure relief valve 28 is in fluid communication with the inflatable chamber 14 and functions as a failsafe valve in the event that the primary pressure relief valve 27 is not functional.

Figure 2:
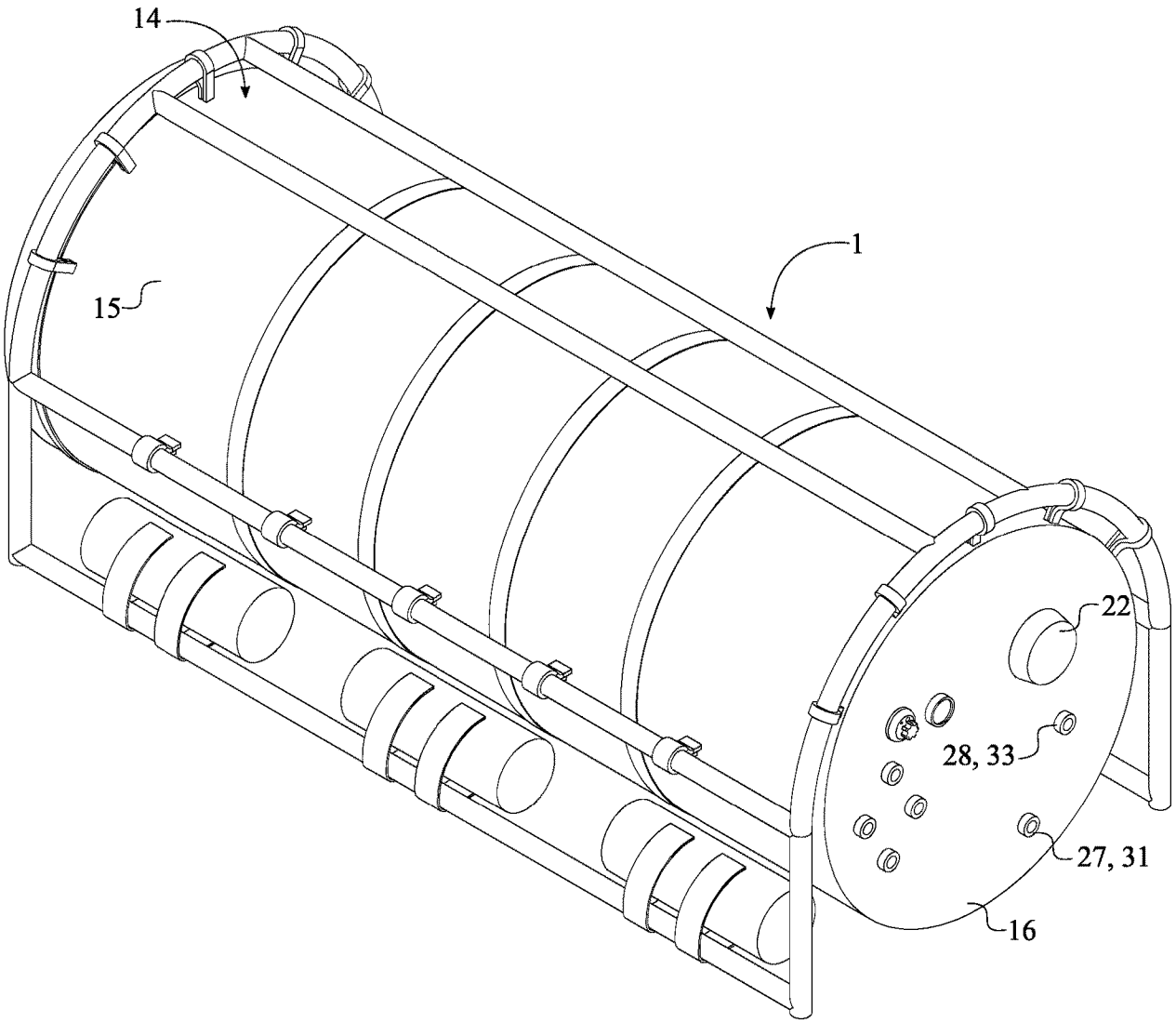
FIG. 2 is a rear perspective view of the present invention.
Figure 5:
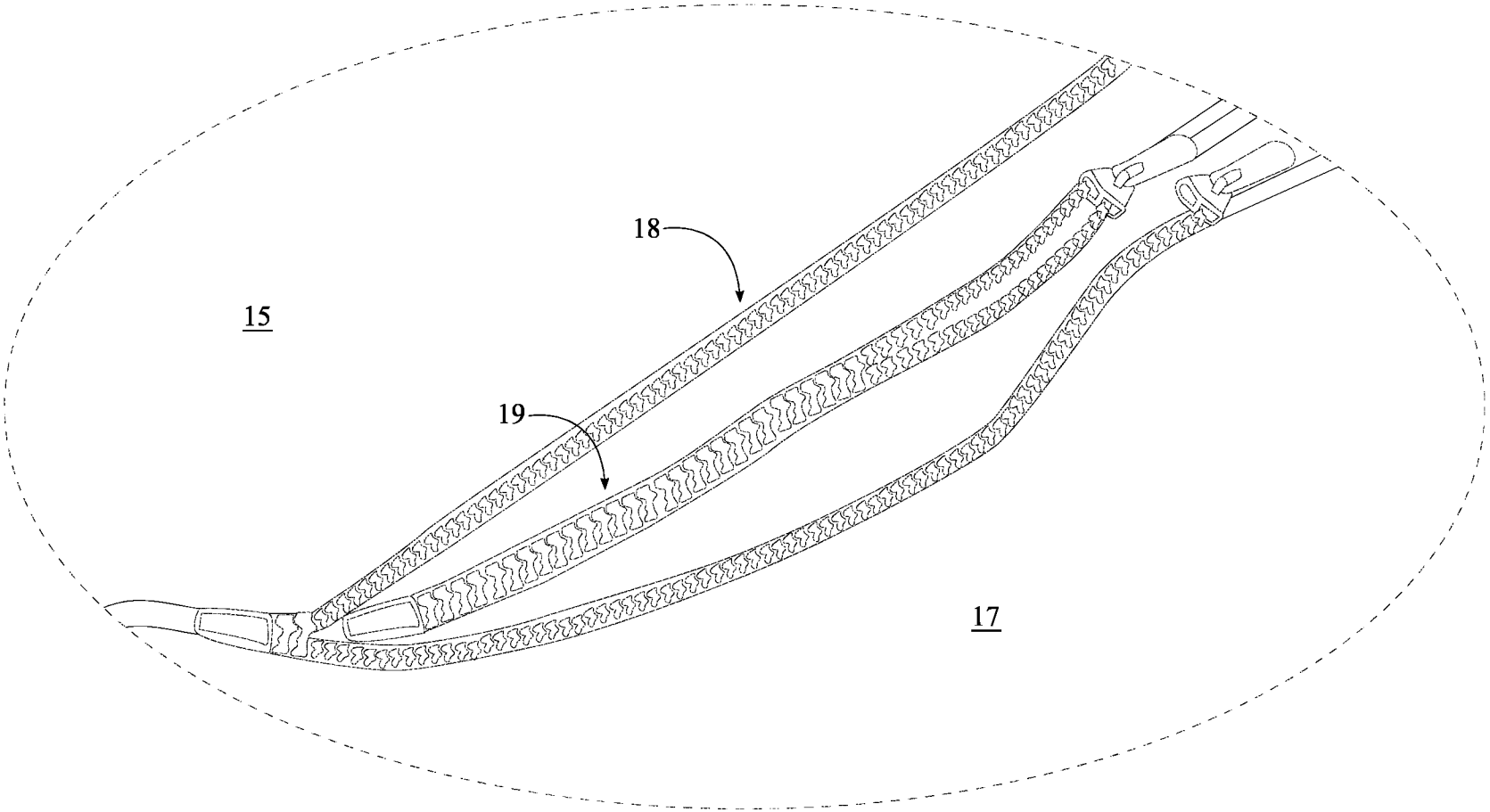
FIG. 5 is a detailed view showing the positioning of the exterior zipper and the interior zipper of the present invention.

In reference to FIG. 1-2, the inflatable chamber 14 is preferably an elongated cylindrical-like shaped object and preferred to be of a slightly smaller than the general size of the frame 1. It is preferred that a wall thickness of the lateral panel 15, the rear panel 16, and the door panel 17 is sufficient to support a full-grown adult-sized user and other medical equipment such as wheelchairs, stretchers, and gurneys. It is preferred that the inflatable chamber 14 is made of materials similar to and/or compatible with the material of the frame 1 while also being lightweight, strong, flexible, leak-proof, non-breathable, tough, tear-resistant, non-penetrable, non-rupturing, and/or easily manufacturable. The rear panel 16 provides a permanent connection to the lateral panel 15 while the door panel 17 hingedly is connected to the lateral panel 15. The opening or closing of the door panel 17 is accomplished through an exterior zipper 18 and an interior zipper 19 as shown in FIG. 5. More specifically, the door panel 17 is peripherally attached to the lateral panel 15 by the exterior zipper 18 so that the exterior zipper 18 can support the lateral stress of the inflatable chamber 14 to improve the structural integrity. The door panel 17 is hermetically attached to the lateral panel 15 by the interior zipper 19 in order to prevent pressure loss through the attachment points of the lateral panel 15 and the door panel 17. Both the exterior zipper 18 and the interior zipper 19 can be accessed and operated from the inside of the inflatable chamber 14 or the outside of the inflatable chamber 14. Resultantly, an access opening is delineated between the door panel 17 and the lateral panel 15 thus enabling the user, medical equipment, and/or other accessory components to be move in and out of the inflatable chamber 14.

Figure 6:
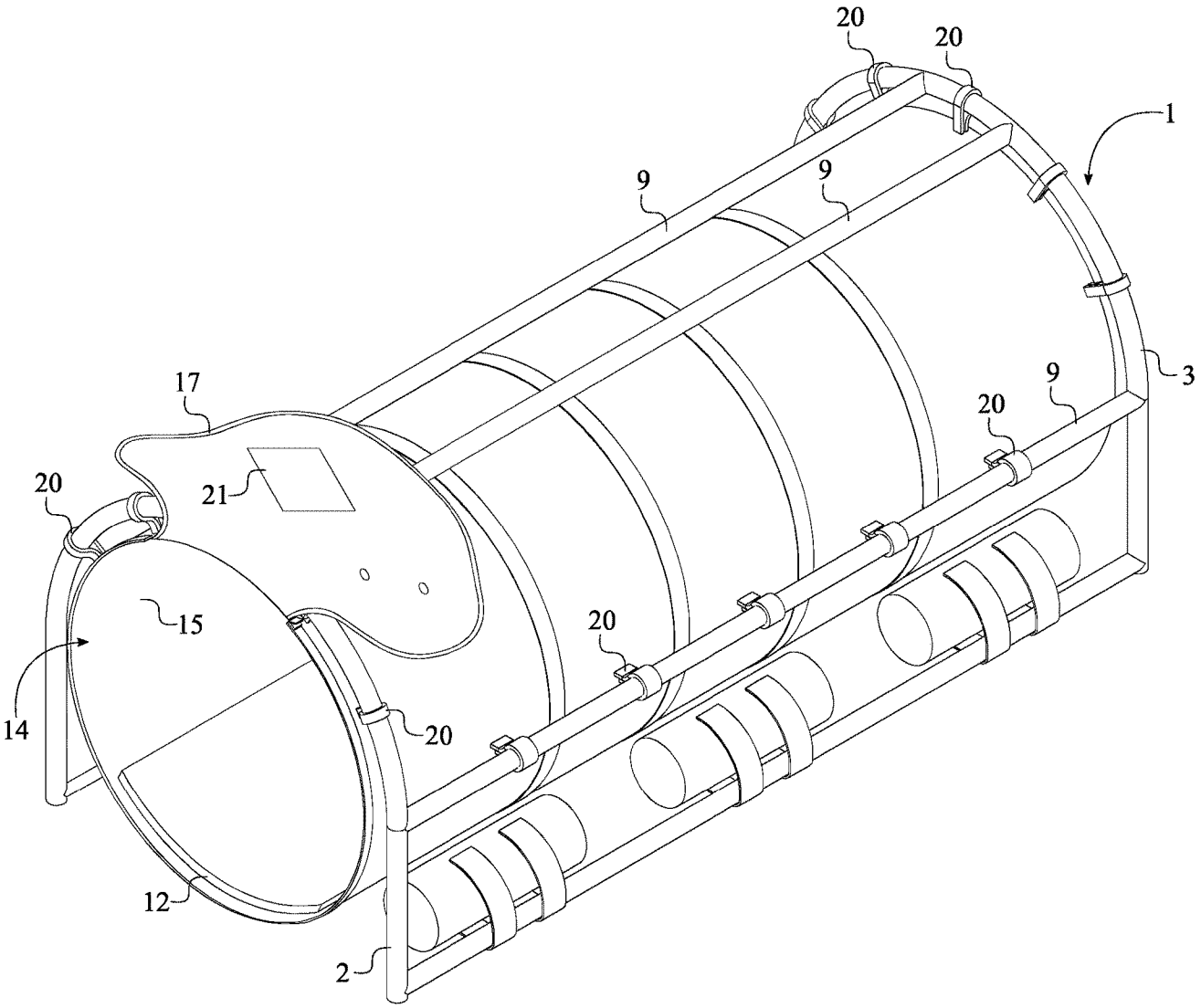
FIG. 6 is a front perspective view of the present invention, wherein the door panel is opening and the floor mat is shown within the inflatable chamber.

In reference to FIG. 6, the present invention further comprises a plurality of lateral support belts 30. More specifically, when the inflatable chamber 14 is at the inflated stage, the lateral panel 15 has a greater hoop stress in comparison to the door panel 17 or the rear panel 16. In order to protect the structural integrity of the lateral panel 15, the plurality of lateral support belts 30 is externally tethered around the lateral panel 15.

Figure 3:
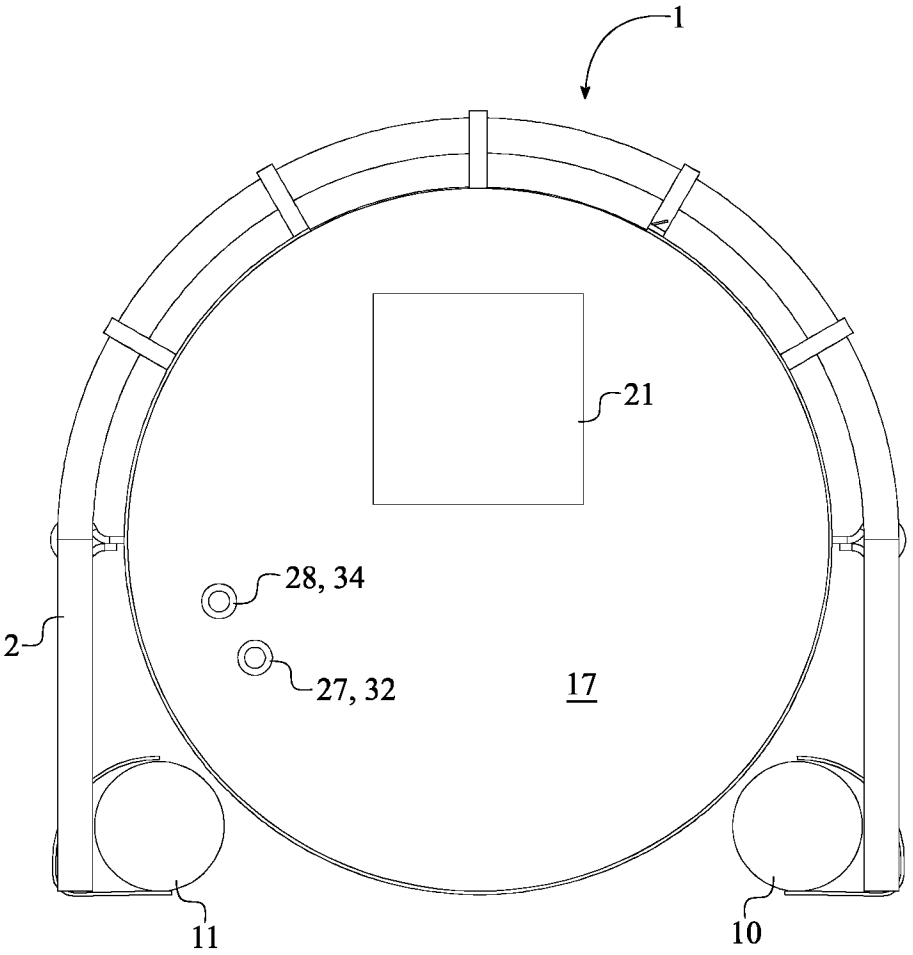
FIG. 3 is a front view of the present invention.
Figure 4:
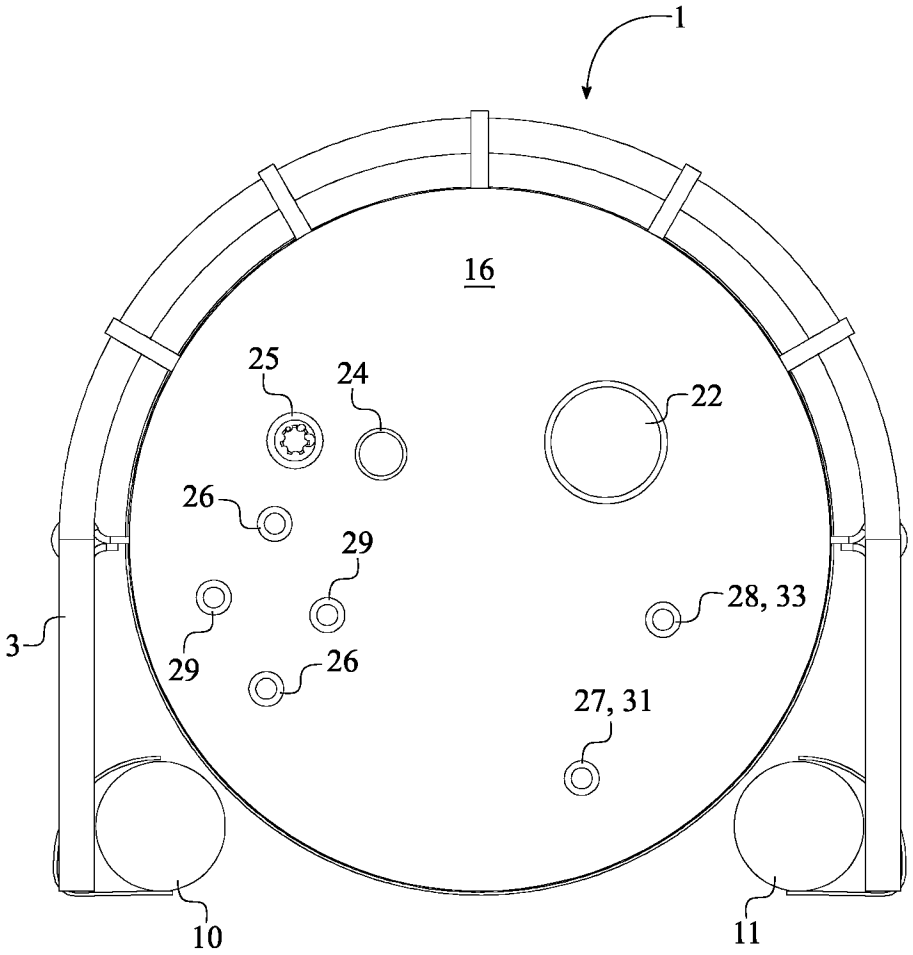
FIG. 4 is a rear view of the present invention.

In reference to FIG. 3-4, the present invention further comprises a front transparent window 21 and a rear transparent window 22. Preferably, the front transparent window 21 and the rear transparent window 22 are located at height wherein the user can easily view the outside of the inflatable chamber 14. The front transparent window 21 is hermetically connected to the door panel 17 so that the user can view the front outside view through the door panel 17. The rear transparent window 22 is hermetically connected to the rear panel 16 so that the user can view the rear outside view through the door panel 17. Furthermore, the front transparent window 21 and the rear transparent window 22 allow light to enter into the inflatable chamber 14.

In reference to FIG. 6, the present invention further comprises a floor mat 12. More specifically, the floor mat 12 is positioned within the inflatable chamber 14 and adjacently positioned over the lateral panel 15. Furthermore, the floor mat 12 is extended from the rear panel 16 to the door panel 17 so that the floor mat 12 is able to completely cover the bottom area of the lateral panel 15. It is preferred that the floor mat 12 be of a material similar to and/or compatible with the material of the inflatable chamber 14 while being of a material that is thick, supportive, and/or comfortable. Since the floor mat 12 is not permanently fixed to the lateral panel 15, users can easily remove and insert the floor mat 12 through the access opening without compromising the structural integrity of the present invention.

Figure 7:
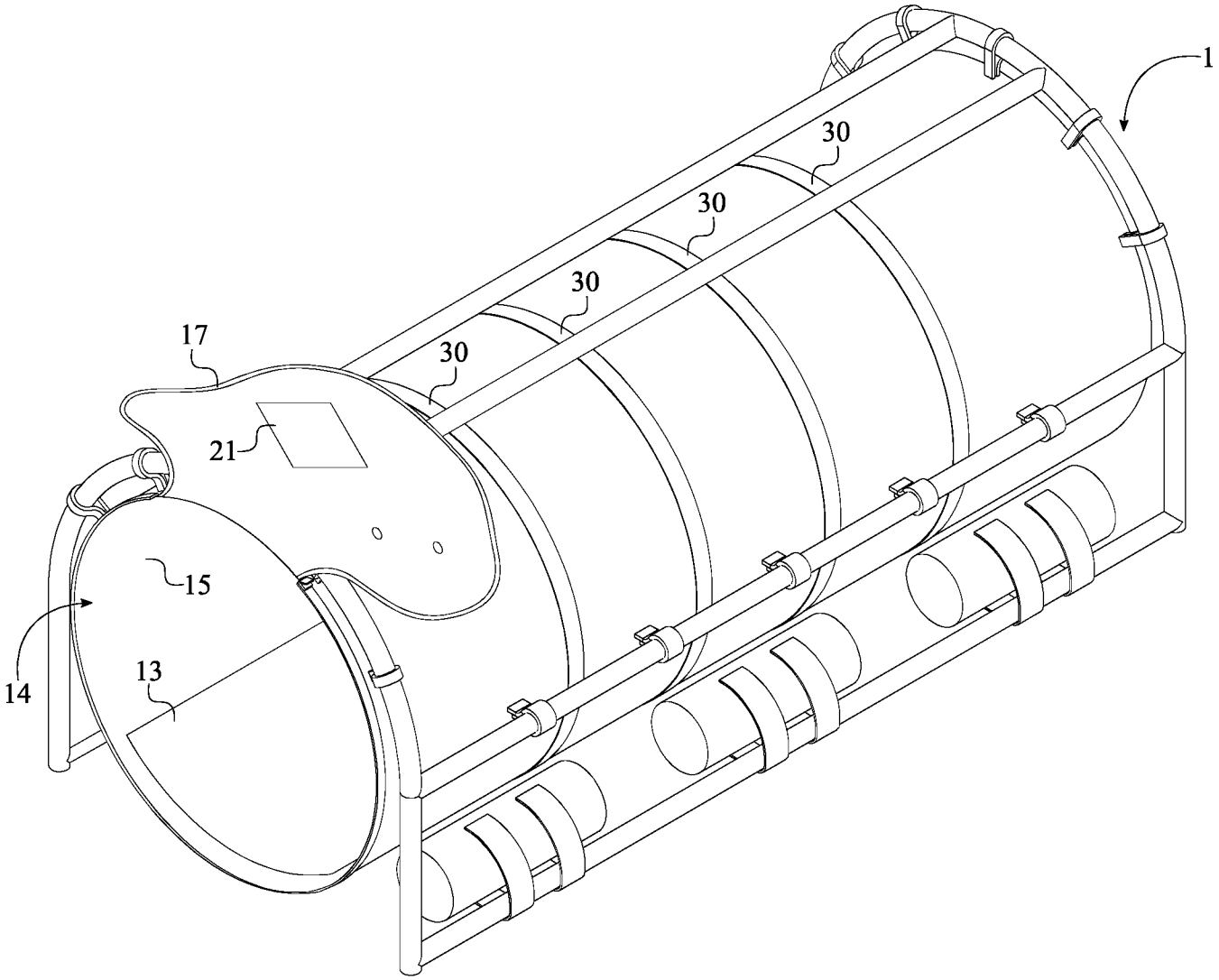
FIG. 7 is a front perspective view of the present invention, wherein the door panel is opening and the carpet is shown within the inflatable chamber.

In reference to FIG. 7, the present invention further comprises a carpet 13. More specifically, the carpet 13 is positioned within the inflatable chamber 14 and adjacently positioned over the lateral panel 15. Furthermore, the carpet 13 is extended from the rear panel 16 to the door panel 17 so that the carpet 13 is able to completely cover the bottom area of the lateral panel 15. It is preferred that the carpet 13 be of a material similar to and/or compatible with the material of the inflatable chamber 14 while being of a material that is thick, supportive, and/or protective. Since the carpet 13 is not permanently fixed to the lateral panel 15, users can easily remove and insert the carpet 13 through the access opening without compromising the structural integrity of the present invention.

The frame 1 is preferably made of materials that are lightweight, tough, durable, strong, load-bearing, and/or easily manufacturable. It is preferred that the frame 1 be of a general shape such that an upper half of the frame 1 be of a shape similar to an upper half of the inflatable chamber 14 while a bottom half of the frame 1 be shape that is more quadrilateral-like in figure. It is preferred that the frame 1 be of a general size slightly larger than the general size of the inflatable chamber 14 and a modular apparatus to ease the transportation and storage of the frame 1. In reference to FIG. 9, the frame 1 comprises a front U-shaped section 2, a rear U-shaped section 3, a plurality of elongated sections 6. More specifically, each of the plurality of elongated sections 6 is parallelly positioned in between the front U-shaped section 2 and the rear U-shaped section 3. A left terminal end 4 of the front U-shaped section 2 and a left terminal end 4 of the rear U-shaped section 3 are connected to each other by a left bottom section 7 of the plurality of elongated sections 6. A right terminal end 5 of the front U-shaped section 2 and a right terminal end 5 of the rear U-shaped section 3 being connected to each other by a right bottom section 8 of the plurality of elongated sections 6. Resultantly, when the present invention fully assembled, the left bottom section 7 and the right bottom section 8 function as the base structure for the frame 1. At least one intermediate section 9 of the plurality of elongated sections 6 is terminally connected to the front U-shaped section 2 and the rear U-shaped section 3 further strengthening the lateral movement of the front U-shaped section 2 and the rear U-shaped section 3. Alternatively, the frame 1 can also be made of a singular apparatus as long as the singular apparatus is able to fulfill the aforementioned functionalities.

In reference to FIG. 6, the present invention further comprises a plurality of loops 20. The plurality of loops 20 is externally connected onto the lateral panel 15 and engaged around the front U-shaped section 2, the rear U-shaped section 3, and the at least one intermediate section 9 so that the lateral panel 15 can be secured to the frame 1. The plurality of loops 20 opens and closes through a fastening mechanism such as zippers, magnetic fasteners, hook-and-loop fasteners, or any other types of similar fasteners to easily engaged around the front U-shaped section 2, the rear U-shaped section 3, and the at least one intermediate section 9.

Figure 9:
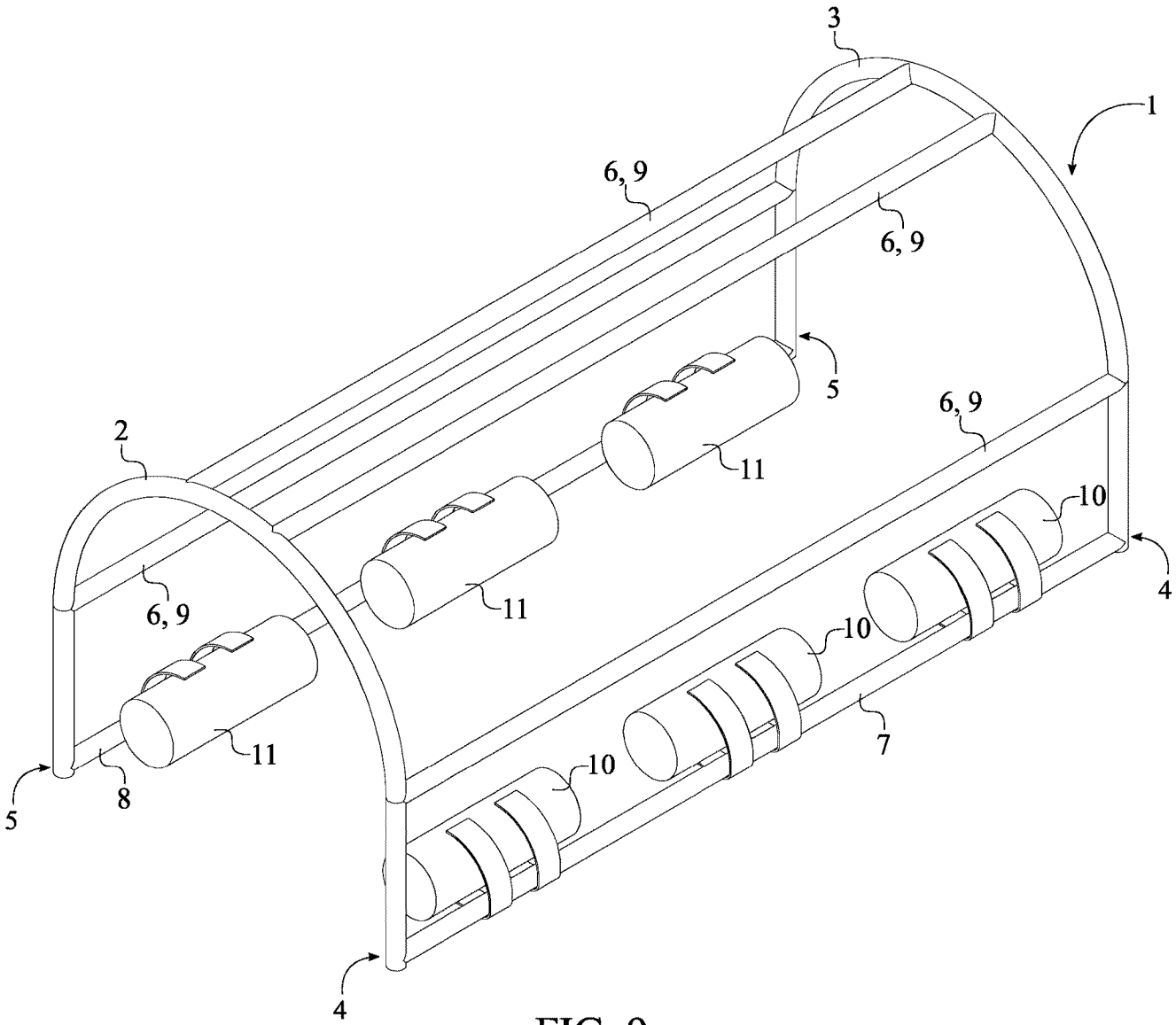
FIG. 9 is a perspective view of the frame of the present invention along with the left and right anchors.

In reference to FIG. 3 and FIG. 9, the present invention further comprises at least one left anchor 10 and at least one right anchor 11. The left anchor 10 and the right anchor 11 are preferably weight down bodies that can maintain a stationary position for the inflatable chamber 14 within the frame 1. The right anchor 11 is positioned in between the lateral panel 15 and the right bottom section 8 and preferably attached to the right bottom section 8 with a plurality of straps. The left anchor 10 is positioned in between the lateral panel 15 and the left bottom section 7 and preferably attached to the left bottom section 7 a plurality of straps. As a result, the right anchor 11 and the left anchor 10 are able to eliminate lateral movement of the inflatable chamber 14 with respect to the left bottom section 7 and the right bottom section 8. Furthermore, the left anchor 10 and the right anchor 11 are able to function as weight down bodies to maintain a stationary position foe the frame 1. Alternatively, the left anchor 10 and the right anchor 11 can be respectively integrated into the left bottom section 7 and the right bottom section 8 as a single component.

Figure 8:
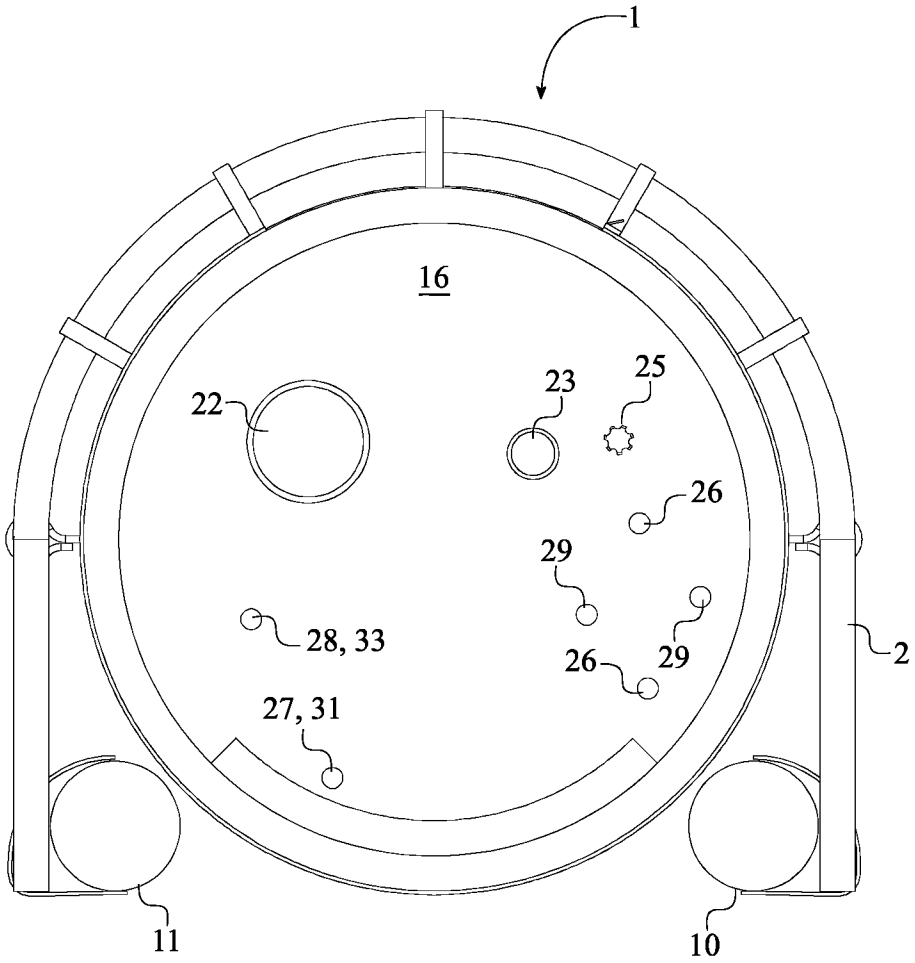
FIG. 8 is a front view of the present invention, wherein the inside view of inflatable chamber is shown.

In reference to FIG. 8, the present invention further comprises an internal pressure gage 23. The internal pressure gage 23 is connected to the rear panel 16 and internally positioned about the inflatable chamber 14 so that an inside pressure of the inflatable chamber 14 is displayed through the internal pressure gage 23. The internal pressure gauge can be a mechanical pressure gauge or an electronic pressure gauge as the inside pressure of the inflatable chamber 14 is continuously measured and displayed through a display screen of the internal pressure gauge. Furthermore, the display screen is preferably color-coded for simplified reading while the numerical pressure value is displayed with accuracy of a plus or minus five percent. For example, a first color of the display screen along with the numerical values indicates that the inside pressure is below the operating pressure of the inflatable chamber 14. A second color of the display screen along with the numerical values indicates that the inside pressure is at the operating pressure of the inflatable chamber 14. A third color of the display screen along with the numerical values indicates that the inflatable chamber 14 is above the operating pressure. Due to the different colors and their respective numerical values, the users of the present invention can easily monitor the inside operating pressure of the inflatable chamber 14 while being inside of the inflatable chamber 14.

In reference to FIG. 4, the present invention further comprises an external pressure gage 24. The external pressure gage 24 is connected to the rear panel 16 and external positioned about the inflatable chamber 14 so that an inside pressure of the inflatable chamber 14 is displayed through the external pressure gage 24. The external pressure gauge can be a mechanical pressure gauge or an electronic pressure gauge as the inside pressure of the inflatable chamber 14 is continuously measured and displayed through a display screen of the external pressure gauge. Furthermore, the display screen is preferably color-coded for simplified reading while the numerical pressure value is displayed with accuracy of a plus or minus five percent. For example, a first color of the display screen along with the numerical values indicates that the inside pressure is below the operating pressure of the inflatable chamber 14. A second color of the display screen along with the numerical values indicates that the inside pressure is at the operating pressure of the inflatable chamber 14. A third color of the display screen along with the numerical values indicates that the inflatable chamber 14 is above the operating pressure. Due to the different colors and their respective numerical values, a caregiver or an operator of the present invention can easily monitor the inside operating pressure of the inflatable chamber 14 while being outside of the inflatable chamber 14.

In reference to FIG. 4, the plurality of fill valves 29 is connected to the rear panel 16 so that the inflatable chamber 14 can be pressurized through the at least one compressor. More specifically, the at least one compressor is in fluid communication with the plurality of fill valves 29 through medical grade quick-connect fittings and tubes so that compressed air can be pumped into the inflatable chamber 14. In the preferred embodiment of the present invention, the plurality of fill valves 29 comprises a first fill valve and a second fill valve to quickly pressurize the inflatable chamber 14. Preferably, the first fill valve is in fluid communication with a first compressor of the at least one compressor while the second fill valve is in fluid communication with a second compressor of the at least one compressor. Individual and duel compressor connection to the plurality of fill valves 29 further enhances the efficiency of the present invention even though a single compressor is sufficient enough to operate the present invention. The at least one compressor must remain in the on-position for the entire treatment period to ensure the proper air circulation and exchange so that a safe and comfortable treatment environment can be obtained for the user. Optionally, each of the plurality of fill valves 29 comprises a built-in muffler to reduce the noise of air entering into the inflatable chamber 14 and a removable air filter to purify the air entering into the inflatable chamber 14

Figure 10:
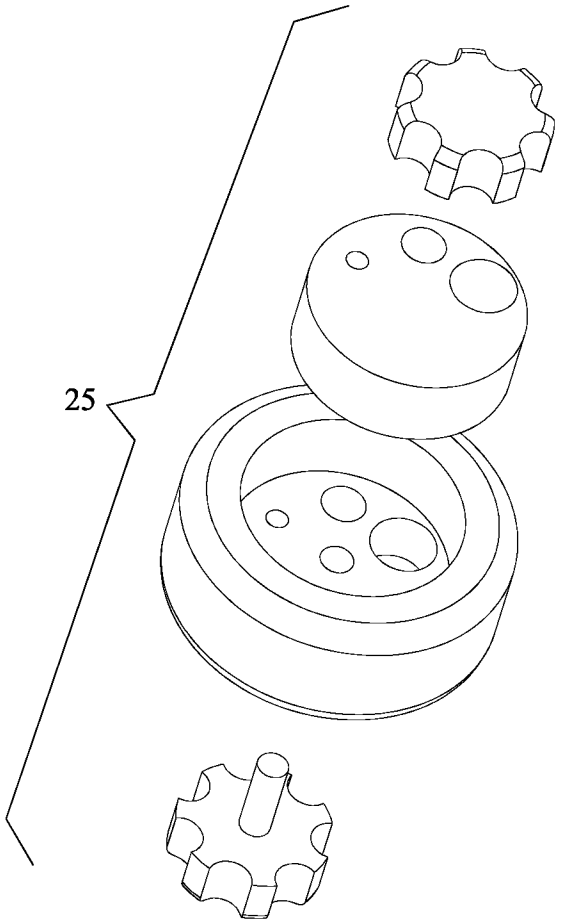
FIG. 10 is a preferred exploded embodiment for the dump valve of the present invention.

In reference to FIG. 4 and FIG. 8, the dump valve 25 is connected to the rear panel 16 so that the inflatable chamber 14 can be quickly deflated. More specifically, the dump valve 25 allows the user or the care giver to either manually control the inside pressure of the inflatable chamber 14 or to deflate the inflatable chamber 14. A preferred embodiment of the dump valve 25 comprises a stationary plate, a plurality of stationary holes, a rotary plate, a plurality of rotary holes, an outside knob, and an inside knob as shown in FIG. 10. The stationary plate is connected to the rear panel 16, and the plurality of stationary holes is radially positioned on the stationary plate. Each of the plurality of stationary holes has a different diameter, where each of the plurality of stationary holes differs from one another. The rotary plate is rotatably connected with the stationary plate, where the rotary plate is adjacently positioned with the stationary plate from outside of the rear panel 16. The plurality of rotary holes is radially positioned on the rotary plate. Each of the plurality of rotary holes has a different diameter, where each of the plurality of rotary holes differs from one another. Since each of the plurality of stationary holes and each of the plurality of rotary holes have different diameters, The plurality of stationary holes and the plurality of rotary holes are positioned in the order of increasing size, such that a small hole is adjacent to a medium hole, the medium hole is in between the small hole and a large hole, and the large hole is adjacent to the medium hole. The outside knob is concentrically connected with the rotary plate and allows the care giver standing outside of the inflatable chamber 14 to manually control inside pressure. The inside knob is concentrically traversed through the stationary plate and connected with the rotary plate in such way that the inside knob is oppositely positioned from the outside knob. The inside knob allows the user within the inflatable chamber 14 to manually control the inside pressure without exiting the inflatable chamber 14.

In reference to a preferred operation of the dump valve 25, the dump valve 25 is operated by turning the outside knob or the inside knob which turns the rotary plate, changing the alignment of the plurality of rotary holes with respect to the plurality of stationary holes. As shown in FIG. 11-A, when none of the plurality of rotary holes is aligned with the plurality of stationary holes, the dump valve 25 is completely sealed and the pressure inside the inflatable remains constant. As shown in FIG. 11-D, when all of the plurality of rotary holes is aligned with the plurality of stationary holes, the dump valve 25 is working at its full capacity. In reference to FIG. 11-B, 11-C, 11-E, and 11-F, by only aligning some of the plurality of rotary holes with the plurality of stationary holes, the dump valve 25 can be used to adjust the rate of depressurization. In reference to FIG. 11-F, the first example that aligns some of the plurality of rotary holes with the plurality of stationary holes shows that the large hole of the plurality of stationary holes is aligned with the small hole of the plurality of rotary holes, letting out a small amount of air, since the small hole of the plurality of rotary holes bottlenecks the large hole of the plurality of stationary holes. In reference to FIG. 11-E, the second example that aligns some of the plurality of rotary holes with the plurality of stationary holes shows The large hole and the medium hole of the plurality of stationary holes are aligned with the medium hole and the small hole of the plurality of rotary holes, which would release a larger amount of air. These two sample configurations allow some depressurization to occur, but not as much when compared to having all of the plurality of rotary holes align with the plurality of stationary holes.

In reference to FIG. 3-4, the at least one primary pressure relief valve 27 comprises a first relief valve 31 and a second relief valve 32. The first relief valve 31 is connected to the rear panel 16. The second relief valve 32 is connected to the door panel 17. The first relief valve 31 and the second relief valve 32 are activated at a lower pressure of the inflatable chamber 14 so that the present invention can maintain an operating pressure within the inflatable chamber 14. More specifically, the first relief valve 31 and the second relief valve 32 automatically open once the inflatable chamber 14 is fully pressurized the operating pressure wherein the lower pressure is equal to the operating pressure. Preferably, the lower pressure of the inflatable chamber 14 is at 4.4 psi to provide a comfortable and safe environment for the user. Furthermore, the first relief valve 31 and the second relief valve 32 allow the circulation of fresh air within the inflatable chamber 14 and the expulsion of carbon-dioxide out of the inflatable chamber 14 while maintaining the constant operating pressure within the present invention. In other words, when the first relief valve 31 and the second relief valve 32 are opened, circulated air within the inflatable chamber 14 exits through the present invention and allow fresh air to enter into the inflatable chamber 14 through the plurality of fill valves 29. Due to the fact lower hoop stress is applied to the door panel 17 and the rear panel 16 in comparison to the lateral panel 15, the structural integrity of the first relief valve 31 and the second relief valve 32 can be further improved within the present invention.

In reference to FIG. 3-4, the at least one secondary pressure relief valve 28 comprises a third relief valve 33 and a fourth relief valve 34. The third relief valve 33 is connected to the rear panel 16. The fourth relief valve 34 is connected to the door panel 17. The third relief valve 33 and the fourth relief valve 34 are activated at a higher pressure of the inflatable chamber 14 so that the present invention can maintain a safe operating pressure within the inflatable chamber 14. More specifically, the third relief valve 33 and the fourth relief valve 34 automatically open when in the inside pressure of the inflatable chamber 14 continue to rise beyond the operating pressure, wherein the higher pressure is equal to the safe operating pressure. Preferably, the higher pressure of the inflatable chamber 14 is at 4.6 psi to provide a safe environment for the user without compromising the integrity of the present invention. Furthermore, the third relief valve 33 and the fourth relief valve 34 allow the circulation of fresh air within the inflatable chamber 14 and the expulsion of carbon-dioxide out of the inflatable chamber 14 while maintaining the safe operating pressure within the present invention. In other words, when the third relief valve 33 and the fourth relief valve 34 are opened, circulated air within the inflatable chamber 14 exits through the present invention and allow fresh air to enter into the inflatable chamber 14 through the plurality of fill valves 29. Due to the fact lower hoop stress is applied to the door panel 17 and the rear panel 16 in comparison to the lateral panel 15, the structural integrity of the third relief valve 33 and the fourth relief valve 34 can be further improved within the present invention.

In reference to FIG. 4, the present invention further comprises a plurality of auxiliary ports 26. More specifically, the plurality of auxiliary ports 26 is connected to the rear panel 16 in such way that the plurality of auxiliary ports 26 traverses through the rear panel 16. The plurality of auxiliary ports 26 is in fluid communication with the inflatable chamber 14 so that optional medical equipment such as oxygen suppling system or gas sampling system can be operatively coupled with the present invention.

The present invention can further comprise a stretcher attachment. More specifically, a preferred embodiment of the stretcher attachment comprises a L-shaped support bracket and an extended plank attached to the L-shaped support bracket. The extended plank is of a flat, quadrilateral-like shaped figure to facilitate for easier transportation of individuals and objects in and out of the inflatable chamber 14.

The present invention can further comprise an inflatable seat so that the user can sit within the inflatable chamber 14. It is preferred that the inflatable seat be pre-inflated at set pressure value higher than the pressure value of the inflatable chamber 14.

Although the invention has been explained in relation to its preferred embodiment, it is to be understood that many other possible modifications and variations can be made without departing from the spirit and scope of the invention as hereinafter claimed.

What is claimed is:

1. A portable hyperbaric chamber device with forward-facing door comprising:

a frame;

an inflatable chamber;

a dump valve;

at least one primary pressure relief valve;

at least one secondary pressure relief valve;
a plurality of fill valves;
the inflatable chamber comprising a lateral panel, a rear panel, and a door panel;
the rear panel and the door panel being oppositely positioned of each other about the lateral panel;
the rear panel being perimetrically connected to the lateral panel;
the door panel being mounted to the lateral panel;
the inflatable chamber being positioned within the frame;
the lateral panel being externally attached to the frame;
the dump valve being in fluid communication with the inflatable chamber;
the primary pressure relief valve being in fluid communication with the inflatable chamber;
the secondary pressure relief valve being in fluid communication with the inflatable chamber; and
the plurality of fill valves being in fluid communication with the inflatable chamber.

2. The portable hyperbaric chamber device with forward-facing door as claimed in claim 1 comprising:
the frame comprising a front U-shaped section, a rear U-shaped section, a plurality of elongated sections;
each of the plurality of elongated sections being parallelly positioned in between the front U-shaped section and the rear U-shaped section;
a left terminal end of the front U-shaped section and a left terminal end of the rear U-shaped section being connected to each other by a left bottom section of the plurality of elongated sections;
a right terminal end of the front U-shaped section and a right terminal end of the rear U-shaped section being connected to each other by a right bottom section of the plurality of elongated sections; and
at least one intermediate section of the plurality of elongated sections being terminally connected to the front U-shaped section and the rear U-shaped section.

3. The portable hyperbaric chamber device with forward-facing door as claimed in claim 2 comprising:
a plurality of loops;
the plurality of loops being externally connected onto the lateral panel; and
the plurality of loops being engaged around the front U-shaped section, the rear U-shaped section, and the at least one intermediate section.

4. The portable hyperbaric chamber device with forward-facing door as claimed in claim 2 comprising:
at least one left anchor;
the left anchor being positioned in between the lateral panel and the left bottom section; and
the left anchor being attached to the left bottom section.

5. The portable hyperbaric chamber device with forward-facing door as claimed in claim 2 comprising:
at least one right anchor;
the right anchor being positioned in between the lateral panel and the right bottom section; and
the right anchor being attached to the right bottom section.

6. The portable hyperbaric chamber device with forward-facing door as claimed in claim 1 comprising:
an exterior zipper;
an interior zipper;
the door panel being hingedly connected to the lateral panel;
the door panel being peripherally attached to the lateral panel by the exterior zipper; and
the door panel being hermetically attached to the lateral panel by the interior zipper.

7. The portable hyperbaric chamber device with forward-facing door as claimed in claim 1 comprising:
a floor mat;
the floor mat being positioned within the inflatable chamber;
the floor mat being extended from the rear panel to the door panel; and
the floor mat being adjacently positioned over the lateral panel.

8. The portable hyperbaric chamber device with forward-facing door as claimed in claim 1 comprising:
a carpet;
the carpet being positioned within the inflatable chamber;
the carpet being extended from the rear panel to the door panel; and
the carpet being adjacently positioned over the lateral panel.

9. The portable hyperbaric chamber device with forward-facing door as claimed in claim 1 comprising:
a front transparent window; and
the front transparent window being hermetically connected to the door panel.

10. The portable hyperbaric chamber device with forward-facing door as claimed in claim 1 comprising:
a rear transparent window; and
the rear transparent window being hermetically connected to the rear panel.

11. The portable hyperbaric chamber device with forward-facing door as claimed in claim 1 comprising:
an internal pressure gage;
the internal pressure gage being connected to the rear panel; and
the internal pressure gage being internally positioned about the inflatable chamber, wherein an inside pressure of the inflatable chamber is displayed through the internal pressure gage.

12. The portable hyperbaric chamber device with forward-facing door as claimed in claim 1 comprising:
an external pressure gage;
the external pressure gage being connected to the rear panel; and
the external pressure gage being externally positioned about the inflatable chamber, wherein an inside pressure of the inflatable chamber is displayed through the external pressure gage.

13. The portable hyperbaric chamber device with forward-facing door as claimed in claim 1 comprising:
the at least one primary pressure relief valve comprising a first relief valve and a second relief valve;
the first relief valve being connected to the rear panel;
the second relief valve being connected to the door panel; and
the first relief valve and the second relief valve being activated at a lower pressure of the inflatable chamber.

14. The portable hyperbaric chamber device with forward-facing door as claimed in claim 13, wherein the lower pressure of the inflatable chamber is at 4.4 psi.

15. The portable hyperbaric chamber device with forward-facing door as claimed in claim 1 comprising:
the at least one secondary pressure relief valve comprising a third relief valve and a fourth relief valve;
the third relief valve being connected to the rear panel;
the fourth relief valve being connected to the door panel; and
the third relief valve and the fourth relief valve being activated at a higher pressure of the inflatable chamber.

16. The portable hyperbaric chamber device with forward-facing door as claimed in claim 15, wherein the higher pressure of the inflatable chamber is at 4.6 psi.

17. The portable hyperbaric chamber device with forward-facing door as claimed in claim 1 comprising:

the plurality of fill valves being connected to the rear panel; and the dump valve being connected to the rear panel.

18. The portable hyperbaric chamber device with forward-facing door as claimed in claim 1 comprising:

a plurality of auxiliary ports;

the plurality of auxiliary ports being connected to the rear panel; and the plurality of auxiliary ports being in fluid communication with the inflatable chamber.

19. The portable hyperbaric chamber device with forward-facing door as claimed in claim 1 comprising:

a plurality of lateral support belts; and the plurality of lateral support belts being externally tethered around the lateral panel.

* * * * *